United States Patent [19]

Durr

[11] Patent Number: 4,727,723

[45] Date of Patent: Mar. 1, 1988

[54] METHOD FOR SUB-COOLING A NORMALLY GASEOUS HYDROCARBON MIXTURE

[75] Inventor: Charles A. Durr, Houston, Tex.

[73] Assignee: The M. W. Kellogg Company, Houston, Tex.

[21] Appl. No.: 65,743

[22] Filed: Jun. 24, 1987

[51] Int. Cl.[4] ..... F17C 13/00

[52] U.S. Cl. ..... 62/54; 220/85 VR

[58] Field of Search ..... 62/54; 55/88, 89; 220/85 VR, 85 VS

[56] References Cited

U.S. PATENT DOCUMENTS

| | | | |
|---|---|---|---|
| 3,108,446 | 10/1963 | Sohda et al. | 62/54 |
| 3,251,191 | 5/1966 | Reed | 62/45 |
| 3,302,416 | 2/1967 | Proctor et al. | 62/45 |
| 3,303,660 | 2/1967 | Berg | 62/51 |
| 3,420,068 | 1/1969 | Petit | 62/54 |
| 3,516,262 | 6/1970 | Bernstein | 62/28 |
| 3,733,838 | 5/1973 | Delahunty | 62/54 |
| 3,780,534 | 12/1973 | Lofredo et al. | 62/28 |
| 3,857,245 | 12/1974 | Jones | 60/651 |
| 3,874,185 | 4/1975 | Etzbach | 62/54 |
| 3,886,759 | 6/1975 | McNamee | 62/54 |
| 3,889,485 | 6/1975 | Swearingen | 62/54 |
| 3,970,441 | 7/1976 | Etzbach et al. | 62/54 |
| 4,110,091 | 8/1978 | Daeschler et al. | 62/54 |
| 4,249,387 | 2/1981 | Crowley | 62/54 |

*Primary Examiner*—Ronald C. Capossela

[57] ABSTRACT

A method for sub-cooling normally gaseous hydrocarbon mixtures produced in a cryogenic process unit wherein the mixture is introduced to a gas/liquid separator, which may be a storage vessel, and vapor containing at least two components of the mixture is recovered as refrigerant, employed in an open cycle refrigeration system to sub-cool the hydrocarbon mixture, and returned to the separator. The system is particularly useful for sub-cooling a hydrocarbon product stream while, at the same time, recovering boil-off vapor from a cryogenic storage vessel.

9 Claims, 4 Drawing Figures

METHOD FOR SUB-COOLING A NORMALLY GASEOUS HYDROCARBON MIXTURE

This invention relates to a method for sub-cooling normally gaseous hydrocarbon mixtures such as liquefied petroleum gas (LPG), natural gas liquids (NGL), and liquefied natural gas (LNG) associated with small amounts of nitrogen. The invention is particularly useful in recovery of boil-off vapors from cryogenic storage tanks which receive the sub-cooled hydrocarbon mixtures as product streams.

In customary practice, LPG, NGL, and LNG are purified and liquefied in cryogenic, pressure let-down processes employing various chilling media such as single component refrigerant, cascade refrigerant, mixed refrigerant, isentropic expansion, and combinations of these. The resulting product streams are usually sub-cooled below their bubble point in order to reduce boil-off vent losses which result from heat assimilation in storage.

Typically, the storage vessels are located at some distance from the cryogenic process facility. Despite adequate insulation and product sub-cooling, boil-off of lighter components of the stored hydrocarbon mixture invariably occurs to some degree. Loss of boil-off vapor is usually not desired or tolerated. Boil-off vapor is, therefore, typically recovered as a liquid through use of independent, closed cycle systems employing a single component refrigerant and returned to the storage vessel. Regrettably, boil-off rates are not constant because of loading and unloading operations as well as climatic changes. Accordingly, refrigeration systems employed for recovery of boil-off vapor are customarily sized for maximum requirements with the result that a large amount of refrigeration capacity is idle much of the time. The independent, closed cycle refrigerant system has the further disadvantage of a fixed refrigeration temperature. In a propane system, for example, the lowest available refrigerant temperature may be −40° C. which is suitable for recovery of boil-off components expected at the time of plant design. However, changing feedstock or processing conditions may result in the boil-off vapor having an unforeseen higher content of light components which cannot be recovered at the fixed temperature of the refrigerant.

It is therefore an object of this invention to provide a method for sub-cooling normally gaseous hydrocarbon mixtures such as a cryogenic hydrocarbon product stream by utilization of refrigeration that is also employed for recovery of boil-off vapor in a self-balancing system that will accommodate variable boil-off vapor mixtures.

According to the invention, a multi-component, normally gaseous, hydrocarbon process stream is introduced to an adiabatic gas/liquid separation zone from which liquid product is recovered for sale, storage, or further processing and from which vapor is recovered. The vapor is recovered as a gaseous refrigerant containing at least two of the lightest components from the hydrocarbon process stream introduced. The gaseous refrigerant is compressed, condensed, sub-cooled, expanded, vaporized in indirect heat exchange with the incoming stream, and, finally, returned to the gas/liquid separation zone for intermingling with the incoming process stream. Because the refrigerant is used in an open cycle system which opens into the low-pressure end of the principal cryogenic process at the gas/liquid separation zone, the gaseous refrigerant will always contain the lightest components of the incoming stream and, therefore, the refrigeration temperature available for liquefaction of boil-off vapor will rise and fall according to composition of the boil-off gas or vapor flash from the incoming process stream.

Figure 4:
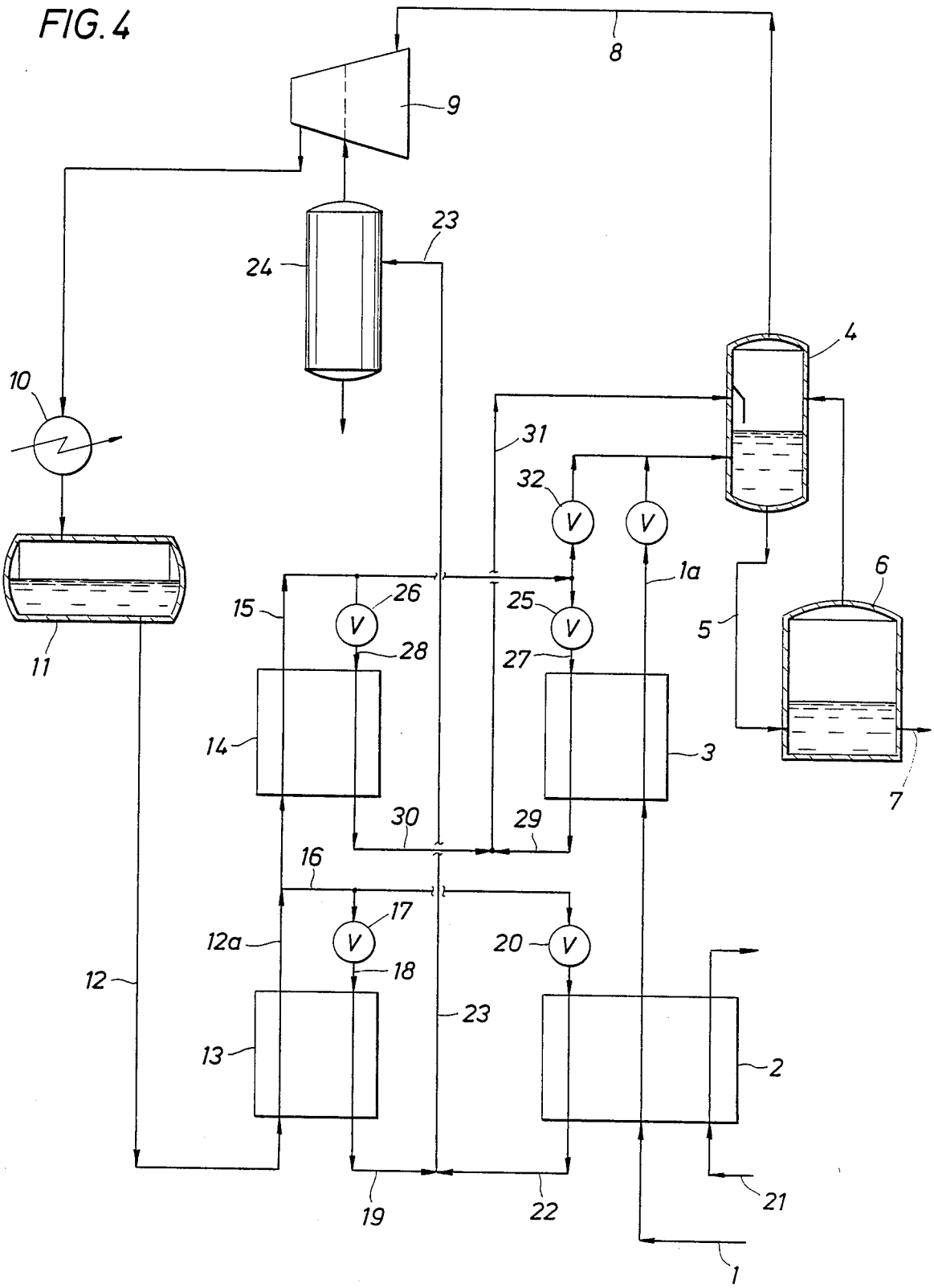
FIG. 4 illustrates use of another preferred embodiment of the invention employing two stage sub-cooling of high-pressure refrigerant liquid in which the incoming process stream being sub-cooled is a propane product stream also containing minor amounts of ethane and butane.

The adiabatic gas/liquid separation zone may be a flash drum separator or a cryogenic storage vessel or a combination of the two, as shown in FIG. 4, according to the specific hydrocarbon mixtures being processed and physical arrangement of the facility. If the storage vessel is proximate to the main cryogenic process facility, it may function as the gas/liquid separator, however, use of a separate flash drum upstream of the storage tank is preferred in order to provide faster system response to changes in the hydrocarbon mixture. The gas/liquid separation zone is adiabatic in contrast to a reboiled fractionator or rectification column notwithstanding the fact that a cryogenic storage tank will have some normal atmospheric heat assimilation. The adiabatic gas/liquid separation zone may be operated at from 0.8 to 2.0 bar but will preferably be operated at slightly above atmospheric pressure (above 0.987 bar).

Figure 1:
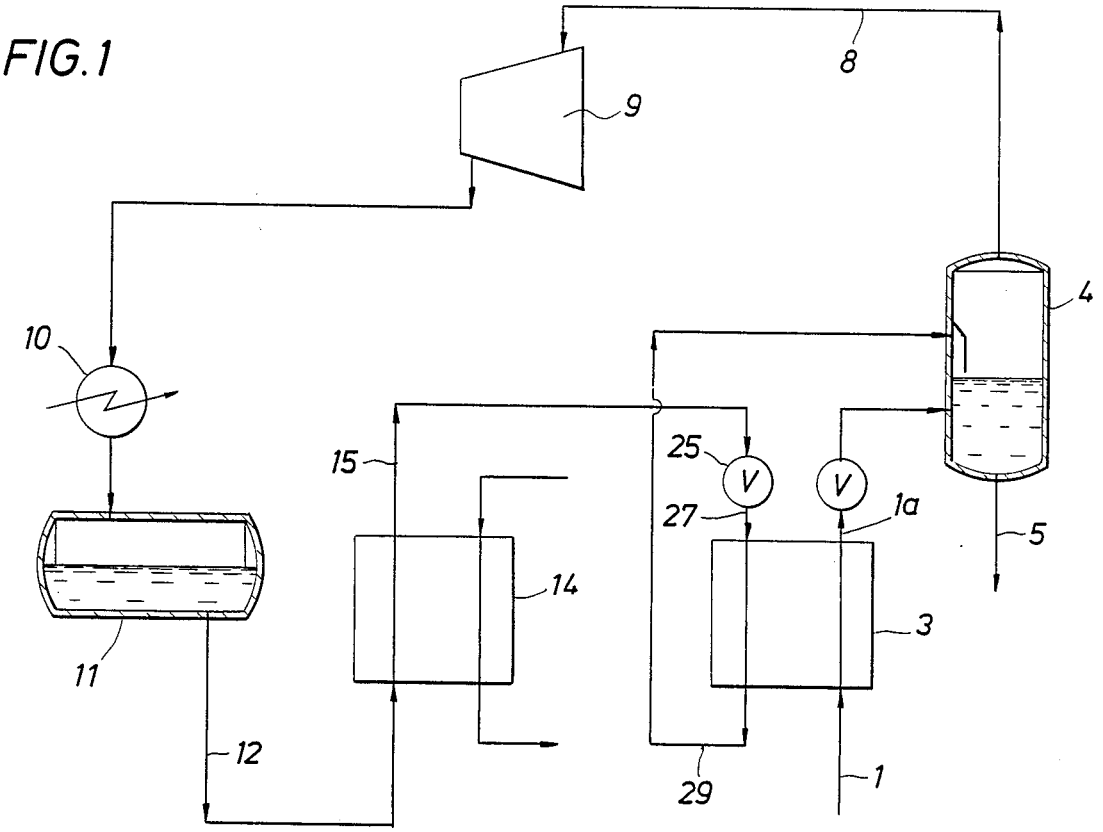
FIG. 1 illustrates an embodiment of the invention in which the condensed refrigerant is sub-cooled prior to expansion by an external refrigerant stream.
Figure 2:
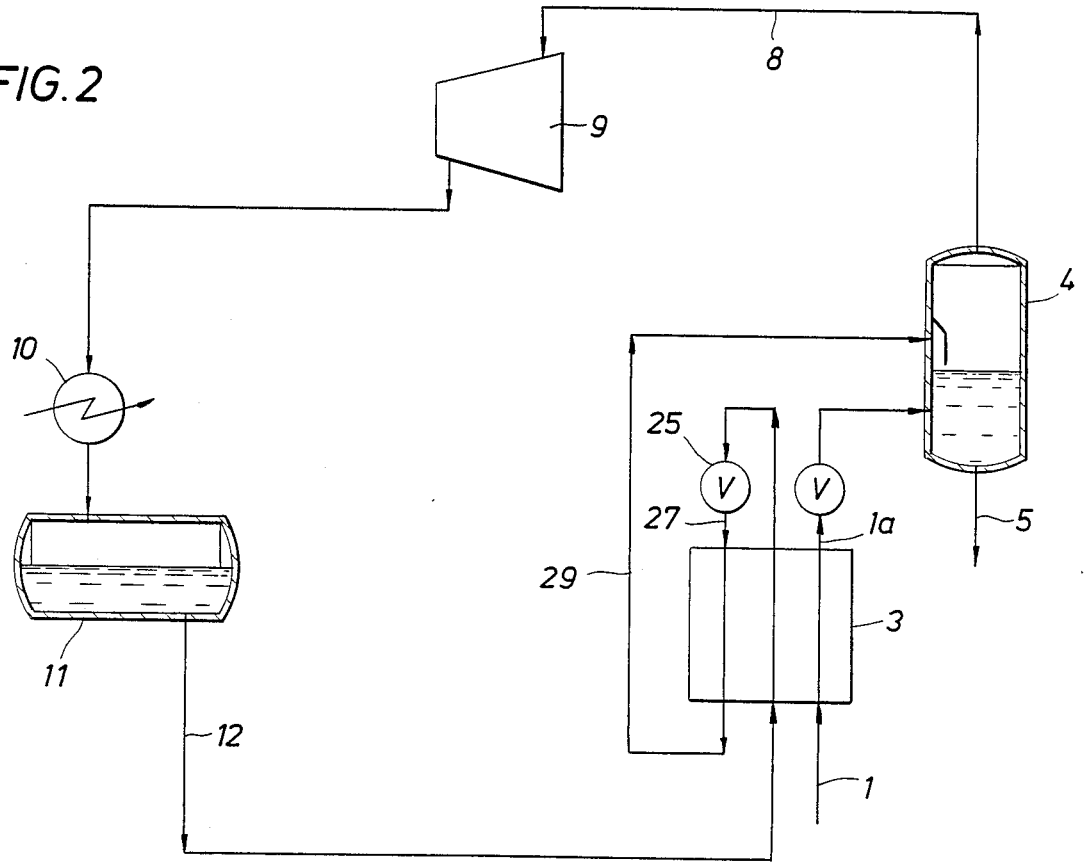
FIG. 2 illustrates an embodiment of the invention wherein the condensed refrigerant is sub-cooled prior to expansion against itself after pressure let-down in the same heat exchange zone in which the incoming hydrocarbon process stream is sub-cooled.

In order to achieve the low refrigerant temperature desired to sub-cool the incoming hydrocarbon process stream to cryogenic storage temperature, it is essential to sub-cool the condensed refrigerant stream as well. Refrigerant may be sub-cooled with an external stream, for example, a refrigerant stream from the main cryogenic process unit as shown in FIG. 1 but is preferably sub-cooled as shown in FIG. 2 by heat exchange with, after expansion, itself in the classic "bootstrap" cooling technique whereby refrigeration from expansion of a stream is utilized to cool the higher pressure predecessor of the expanded stream. Available refrigeration is, of course, also used to sub-cool the incoming process stream. When the incoming stream is principally methane and also contains a minor amount of nitrogen as is usually the circumstance in LNG units, the gaseous refrigerant is compressed to between 14 and 35 bar, condensed, and then sub-cooled to a temperature between −140° and −170° C. prior to expansion for recovery of refrigeration. When the incoming stream is principally ethane and also contains smaller amounts of methane, the gaseous refrigerant is compressed to between 7 and 31 bar, condensed, and sub-cooled to between −70° and −110° C. When the incoming stream is principally propane or butane or, typically, predominantly a propane/butane mixture including some lighter gases, the gaseous refrigerant is compressed to between 3 and 25 bar, condensed, and sub-cooled to between 10° and −60° C.

The sub-cooled refrigerant is expanded to the low pressure of the adiabatic gas/liquid separation zone, preferably, through a Joule-Thompson valve and refrigeration then recovered from the resulting expanded stream without intervening separation of vapor and liquid. Typically, the expanded stream will be a two phase mixture but may be entirely liquid phase if the stream has been sub-cooled to a very low temperature. Recovery of refrigeration by indirect heat exchange with the incoming hydrocarbon process stream and, preferably, also with its higher pressure predecessor stream will, of course, revaporize the refrigerant to predominantly vapor phase for return to the adiabatic gas/liquid separation zone. This return stream is preferably introduced to the physical separator or storage tank, as the case may be, separately from the incoming, liquid phase, sub-cooled, multi-component, hydrocarbon stream expanded into, usually, the same vessel. The point of introduction of the return revaporized stream should be above the point of introduction of the sub-cooled liquid stream to facilitate gas/liquid separation of both streams and recovery of a normally gaseous, liquid phase, hydrocarbon product stream from the vessel or vessels employed in the gas/liquid separation zone.

Figure 3:
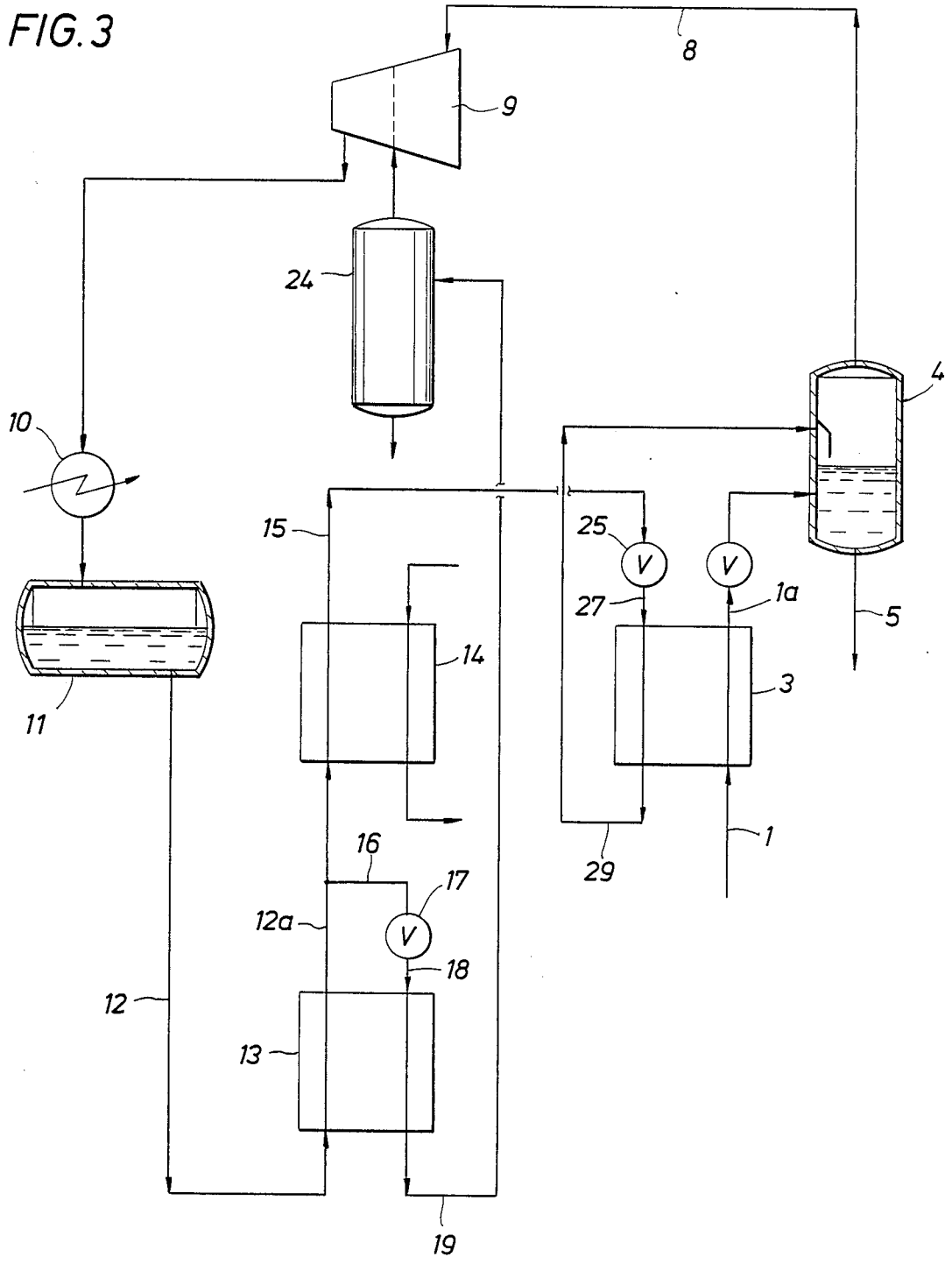
FIG. 3 illustrates a preferred embodiment of the invention wherein the high-pressure refrigerant liquid is sub-cooled prior to expansion in two heat exchange stages and a portion of the initially sub-cooled liquid is expanded to an intermediate pressure in order to provide the initial sub-cooling refrigeration duty.

Preferably, the condensed refrigerant is sub-cooled in two indirect heat exchange stages as shown in FIG. 3 in order to closely match refrigeration duties with the two temperature level refrigerant streams thereby made available. In this embodiment, the entire refrigerant liquid stream is, therefore, initially sub-cooled and a portion of the sub-cooled stream expanded to an intermediate pressure between 2 and 15 bar to provide refrigeration required by the initial sub-cooling. The resulting revaporized refrigerant is then returned to an intermediate pressure point in the gaseous refrigerant compression step, for example, between the stages of a two stage compressor. The balance of the initially sub-cooled refrigerant liquid is then passed to a second stage of heat exchange as described above for final sub-cooling prior to expansion as previously described.

Referring to the drawings and the descriptions thereof, the following nomenclature has been used for functional identification of process streams and treatments:

1. multi-component, normally gaseous, hydrocarbon process stream
1a. liquid phase, sub-cooled, multi-component, normally gaseous, hydrocarbon stream
2. heat exchanger
3. heat exchanger
4. low-pressure, adiabatic gas/liquid separation zone
5. normally gaseous, liquid phase, hydrocarbon product stream
6. LPG storage tank
7. LPG product
8. gaseous refrigerant stream
9. compressor
10. heat exchanger (condenser)
11. accumulator vessel
12. high-pressure refrigerant liquid
12a. initially sub-cooled high-pressure refrigerant liquid
13. heat exchanger
14. heat exchanger
15. first, cold refrigerant liquid
16. second, cold refrigerant liquid
17. expansion valve
18. first, intermediate pressure refrigerant
19. first, intermediate pressure revaporized refrigerant
20. expansion valve
21. butane stream
22. second, intermediate pressure revaporized refrigerant
23. combined, intermediate pressure revaporized refrigerant
24. knock-out drum
25. expansion valve
26. expansion valve
27. first, low-pressure refrigerant
28. second, low-pressure refrigerant
29. first, low-pressure revaporized refrigerant
30. second, low-pressure revaporized refrigerant
31. combined, low-pressure revaporized refrigerant
32. expansion valve It is noted that suitable heat exchangers for use in the process of the invention may be of the shell and tube type or the plate-fin type which permits heat exchange among several streams. While separate heat exchange zones are shown in the drawings for illustrative purpose, these zones may be combined into one or more multiple stream exchangers in accordance with the parameters of specific process designs.

Referring now to FIG. 1, an incoming multi-component, normally gaseous, hydrocarbon process steam which will usually be a liquid phase stream under elevated cryogenic process pressure is sub-cooled in heat exchanger 3 and the resulting sub-cooled stream 1*a* expanded into the low-pressure, adiabatic gas/liquid separation zone indicated by flash separator 4. A normally gaseous, liquid phase hydrocarbon product stream is withdrawn from the bottom of the separator through line 5 and a vapor stream, which constitutes the gaeous refrigerant stream is withdrawn through line 8. The flash separator 4 is preferably operated at or near atmospheric pressure in order to avoid undesirable vacuum conditions at the inlet side of compressor 9. Following compression of the gaseous refrigerant to an elevated pressure, the refrigerant is condensed in heat exchanger 10, typically against water, and accumulated in vessel 11. High-pressure refrigerant liquid is withdrawn from the accumulator on demand through line 12 and sub-cooled in heat exchanger 14 by an external refrigerant stream which may, for example, be available from the principal cryogenic process. This sub-cooling yields a first, cold refrigerant stream 15 which is then expanded through valve 25 and revaporized by heat exchange in 3 with the incoming process stream. The resulting first, low-pressure revaporized refrigerant in line 29 is then returned to flash separator 4.

FIG. 2 shows a process of the invention that is substantially the same as that of FIG. 1 except that an external refrigerant is not needed since the high-pressure refrigerant liquid stream 12 is sub-cooled also in heat exchanger 3 by the first, low-temperature refrigerant stream 27.

In FIG. 3, two stage sub-cooling of high-pressure refrigerant liquid stream 12 is shown in which initial sub-cooling is performed in heat exchanger 13 and a second, cold refrigerant liquid stream 16 is divided out from the initially sub-cooled refrigerant. In this embodiment, the second, cold refrigerant stream has a temperature above that of the first, cold refrigerant stream 15 and is expanded across valve 17 to form a first, intermediate pressure refrigerant which is recovered in heat exchanger 13 to form a first, intermediate pressure revaporized stream 19. Vapor stream 19 is then returned to an interstage point of, now, two stage compressor 9 where it is combined with the gaseous refrigerant stream 8 undergoing compression. Knockout drum 24 is employed to remove any liquid that may be present in stream 19 in order to protect the compressor.

In production of a liquid phase, hydrocarbon product such as that recovered in line 5 of the drawings, it may be appreciated that an increasing concentration of lighter components in the incoming process stream 1 will tend to boil off in storage at an undesirably high rate unless their storage temperature is lowered. From the preceding descriptions, it is apparent that the processes of the invention can achieve production of a lower temperature product stream 5 by virtue of their self-balancing, open cycle characteristic since gaseous refrigerant stream 8 will necessarily contain a higher concentration of lighter components as they are flashed from the incoming stream. The resulting lighter gaseous refrigerant having a correspondingly lower bubble point can therefore achieve lower refrigeration temperatures in heat exchanger 3 and thereby provide lower temperature sub-cooling of the incoming hydrocarbon process stream 1 without use of sub-atmospheric pressures in the system.

Referring now to FIG. 4 which, as previously noted, illustrates a flow scheme of the invention suitable for sub-cooling an LPG stream having the following composition:

| | | |
|---|---|---|
| $C_2$ | = | 2.1 weight % |
| $C_3$ | = | 95.4 weight % |
| $C_4$ | = | 2.5 weight % |
| | | 100.0 weight % |

The LPG process stream 1 is introduced to heat exchanger 2 at a pressure of 17.8 bar and initially sub-cooled to −23° C. The stream is further sub-cooled to −46° C. in heat exchanger 3 and expanded to low pressure into flash separator 4 which is operated at slightly above 1 bar. A normally gaseous, liquid phase, hydrocarbon product stream 5 having substantially the same composition as stream 1 is recovered from the bottom of separator 4 for storage in cryogenic tank 6 from which LPG product is withdrawn through line 7 for sale or further processing.

Boil-off vapor from the LPG storage tank 6 comprised of most of the ethane from product stream is combined with other vapors in separator 4 to form gaseous refrigerant stream 8 having the following composition:

| | | |
|---|---|---|
| $C_2$ | = | 13.9 weight % |
| $C_3$ | = | 86.1 weight % |
| $C_4$ | = | trace |
| | | 100.0 weight % |

The gaseous refrigerant is compressed in two stage compressor 9 to an intermediate pressure of 2.7 bar and then to an elevated pressure of 19.5 bar. High-pressure gaseous refrigerant is then condensed against water in heat exchanger 10 and accumulated in vessel 11. High-pressure refrigerant liquid is withdrawn from the accumulator through line 12 and initially sub-cooled in heat exchanger 13 to −24° C. A portion of the initially sub-cooled refrigerant is further sub-cooled to −46° C. in heat exchanger 14 and withdrawn through line 15 as the first, cold refrigerant liquid. Another portion of the initially sub-cooled refrigerant, still at −24° C., is branched off through line 16 and a portion expanded through valve 17 to form the first, intermediate pressure refrigerant 18 at 3 bar which provides initial sub-cooling of the high-pressure refrigerant liquid in heat exchanger 13 and is thereby vaporized to become the first, intermediate pressure revaporized refrigerant in line 19.

A parallel stream from line 16 is similarly expanded through valve 20 to provide initial sub-cooling for LPG process stream 1 in heat exchanger 2 as well as sub-cooling for a separate butane stream 21 and is thereby vaporized to become the second, intermediate pressure revaporized refrigerant in line 22. The first and second, intermediate pressure revaporized refrigerants are combined in line 23 and returned via knock-out drum 24 to the second stage inlet of compressor 9 at a pressure of 2.7 bar.

Referring back to heat exchanger 14, the first cold refrigerant in line 15 is divided and expanded through valves 25 and 26 to 1.3 bar to form respectively the first, low-pressure refrigerant in line 27 and the second, low-pressure refrigerant in line 28. These streams provide final sub-cooling for the LPG process stream in heat exchanger 3 and the high-pressure refrigerant liquid in heat exchanger 14 and are thereby vaporized to form the first, low-pressure revaporized refrigerant in line 29 and the second, low-pressure revaporized refrigerant in line 30. The revaporized low-pressure streams are combined in line 31 and returned at a temperature of −32° C. to flash separator 4. If refrigeration available in stream 15 is in excess of the sub-cooling requirements in heat exchangers 3 and 14, the excess may be expanded through valve 32 to further sub-cool the LPG product stream by direct heat exchange. In the event that a significant excess of refrigeration is available, it may be utilized in one or more exchangers (not shown) in parallel with heat exchangers 3 and 14.

I claim:

1. A method for sub-cooling a normally gaseous hydrocarbon product stream which comprises:

(a) expanding a liquid phase, sub-cooled, multi-component, normally gaseous, hydrocarbon stream into a low-pressure, adiabatic gas/liquid separation zone;

(b) recovering a gaseous refrigerant stream containing portions of at least two of the lightest components of the multi-component, normally gaseous, hydrocarbon stream from the low-pressure, adiabatic gas/liquid separation zone;

(c) compressing the gaseous refrigerant stream to an elevated pressure and then condensing the stream to form a high-pressure refrigerant liquid;

(d) sub-cooling at least a portion of the high-pressure refrigerant liquid to form a first, cold refrigerant liquid;

(e) expanding at least a portion of the first, cold refrigerant liquid to form a first, low-pressure refrigerant;

(f) vaporizing the first low-pressure refrigerant to form a first low-pressure revaporized refrigerant;

(g) introducing the first low-pressure revaporized refrigerant to the low-pressure, adiabatic gas/liquid separation zone;

(h) sub-cooling a multi-component, normally gaseous, hydrocarbon process stream by indirect heat exchange with the first low-pressure refrigerant to form the liquid phase, sub-cooled, multi-component, normally gaseous, hydrocarbon stream that is expanded into the low-pressure, adiabatic gas/liquid separation zone; and (i) recovering a normally gaseous, liquid phase, hydrocarbon product stream from the low-pressure, adiabatic gas/liquid separation zone.

2. The method of claim 1 wherein the first, low-pressure refrigerant is a two phase mixture.

3. The method of claim 1 wherein the high-pressure refrigerant liquid is sub-cooled by indirect heat exchange with the first, low-pressure refrigerant.

4. The method of claim 1 which additionally comprises:

(a) initially sub-cooling the high-pressure liquid refrigerant and dividing out therefrom a second, cold refrigerant liquid having a temperature above that of the first, cold refrigerant liquid;

(b) expanding at least a portion of the second, cold refrigerant liquid to form a first, intermediate pressure refrigerant;

(c) vaporizing the first, intermediate pressure refrigerant in indirect heat exchange with the high-pressure refrigerant liquid to form a first, intermediate pressure revaporized refrigerant from the first, intermediate pressure refrigerant; and (d) combining the first, intermediate pressure revaporized refrigerant with the gaseous refrigerant stream undergoing compression.

5. The method of claim 4 wherein the first, intermediate pressure revaporized refrigerant is at a pressure between 2 and 15 bar.

6. The method of claim 4 which additionally comprises:

(a) expanding a minor portion of the first, cold refrigerant liquid to form a second, low-pressure refrigerant;

(b) vaporizing the second, low-pressure refrigerant in indirect heat exchange with a portion of the initially sub-cooled high-pressure liquid refrigerant to form a second, low-pressure revaporized refrigerant from the second, low-pressure refrigerant; and (c) introducing the second, low-pressure revaporized refrigerant to the low-pressure, adiabatic gas/liquid separation zone.

7. The method of claim 1 wherein the gaseous refrigerant stream is compressed to an elevated pressure between 3 and 35 bar, and the low-pressure, adiabatic gas/liquid separation zone is operated at a pressure between 0.8 and 2.0 bar.

8. The method of claim 1 wherein the low-pressure, gas/liquid separation zone comprises a storage vessel.

9. The method of claim 1 wherein the low-pressure, adiabatic gas/liquid separation zone comprises a flash separator.

* * * * *